United States Patent [19]

Kramp et al.

[11] 3,961,957

[45] June 8, 1976

[54] DYE BLEACH PREPARATION FOR THE PHOTOGRAPHIC SILVER DYE BLEACH PROCESS

[75] Inventors: Ekkehard Kramp; John Lenoir; Max Marthaler, all of Marly; Robert Schaller, Fribourg, all of Switzerland

[73] Assignee: Ciba-Geigy AG, Basel, Switzerland

[22] Filed: May 10, 1974

[21] Appl. No.: 468,838

[30] Foreign Application Priority Data

May 18, 1973 Switzerland ..... 7124/73

[52] U.S. Cl. ..... 96/53; 96/20; 96/60 R

[51] Int. Cl.[2] ..... G03C 7/00

[58] Field of Search ..... 96/53, 20, 60 R, 60 BF

[56] References Cited

UNITED STATES PATENTS

| | | | |
|---|---|---|---|
| 2,270,118 | 1/1942 | Gaspar | 96/53 |
| 2,564,238 | 7/1951 | Sprung | 96/60 R |
| 3,620,744 | 11/1971 | Schellenberg et al. | 96/20 |
| 3,772,020 | 11/1973 | Smith | 96/60 BF |
| 3,868,253 | 2/1975 | Marthaler et al. | 96/53 |

OTHER PUBLICATIONS

Newman, "The Chemistry of Stabilization Processing", British Journal of Photography, vol. 114, No. 5601, pp. 1009–1012, 1967.

*Primary Examiner*—J. Travis Brown

*Attorney, Agent, or Firm*—Joseph G. Kolodny; Edward McC. Roberts; Prabodh I. Almaula

[57] ABSTRACT

The invention relates to a dye bleach preparation which contains in addition to an acid, a water-soluble iodide and optionally a dye bleach catalyst at least one bifunctional sulphur compound having a sufficient solubility in the preparation and a low vapor pressure and containing at least one HS-group and at least one oxygen, nitrogen, phosphorus or additional sulphur atom, the sulphur atom of each HS-group being separated from the next oxygen, sulphur, nitrogen and phosphorus atom present in the molecule by at least three carbon atoms.

16 Claims, No Drawings

DYE BLEACH PREPARATION FOR THE PHOTOGRAPHIC SILVER DYE BLEACH PROCESS

The subject of the present invention is a dye bleach preparation for the photographic silver dye bleach process, which contains an acid, a water-soluble iodide and optionally a dye bleach catalyst. The preparation is characterised in that it contains at least one organic, at least bifunctional sulphur compound of which the solubility is at least $5\times10^{-4}$ mol per liter of preparation and of which the vapour pressure in the temperature range of −20°C to +100°C is at most as great as that of water, and which contains at least one HS— group and at least one oxygen, nitrogen, phosphorus or additional sulphur atom, with the sulphur atom of each HS— group being separated from the next oxygen, sulphur, nitrogen and phosphorus atom present in the molecule by at least three carbon atoms.

The HS— group can also be separated from the next oxygen, nitrogen, phosphorus or sulphur atom by a ring system, where in every case the shortest link between the two hetero-atoms must comprise at least three carbon atoms.

Preferred sulphur compounds correspond to the formulae (1) to (16) which follow:

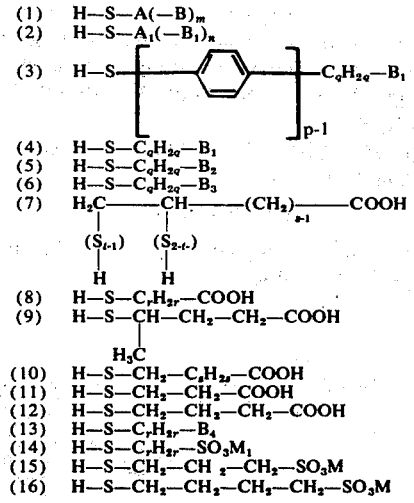

In these formulae, the symbols in every case have the same meaning, and in particular denote the following:

A. an aliphatic, araliphatic or heterocyclic bridge member.

$A_1$. an aliphatic bridge member, an aralkylene radical, an aralkylidene radical or a benzene radical which is bonded, on non-adjacent carbon atoms, to the H-S- and $B_1$-groups.

B. one of the groups of the formulae

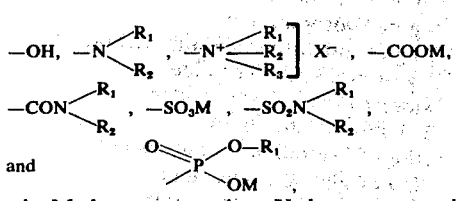

and wherein M denotes a cation, X denotes an anion, $R_1$ and $R_2$ denote a hydrogen atom, a lower alkyl group, a lower hydroxyalkyl group or the radical of a benzenesulphonic acid and $R_3$ denotes a lower alkyl group and $R_1$ and $R_2$ located on the same nitrogen atom can also form a heterocyclic ring with the latter.

$B_1$. one of the groups

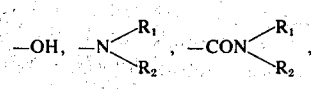

—$SO_3M$, —COOH (for $R_1$ and $R_2$, see above).

$B_2$. one of the groups —COOH, —$SO_3$cation,

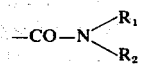

—$N(CH_3)_2$, —$N(C_2H_5)_2$ (for $R_1$ and $R_2$, see above).

$B_3$. one of the groups —COOH, —$SO_3$cation and

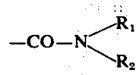

(for $R_1$ and $R_2$, see above).

$B_4$. a carboxylic acid amide group (which can optionally carry one or two substituents on the nitrogen atom) or a sulphonic acid group (optionally in the form of a salt).

$M_1$. one of the cations H, Na, K, $NH_4$,

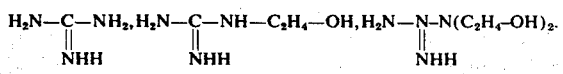

*m*, *n*, *p*, *q*, *r*, *s* and *t* denote integers, as follows:

$1 \leqslant m \leqslant 4$
$1 \leqslant n \leqslant 2$
$1 \leqslant p \leqslant 2$
$2 \leqslant q \leqslant 12$
$2 \leqslant r \leqslant 6$
$1 \leqslant s \leqslant 4$
$1 \leqslant t \leqslant 2$
$3 \leqslant s+t$ The following compounds may be mentioned as examples: 3-Mercapto-propionic acid, 3-mercapto-propionic acid amide, 3-mercapto-propionic acid N-(4′-sulpho-phenyl)amide, 3-mercapto-propionic acid N-(3′-sulpho-phenyl)amide, 3-mercapto-propionic acid N,N-di-(β-hydroxyethyl)-amide, the guanidinium salt of 3-mercapto-propanesulphonic acid, 3-mercapto-1-dimethylaminopropane, 3-mercapto-butyric acid, 4-mercapto-butyric acid, 4-mercapto-butyric acid amide, 4-mercapto-butyric acid N-(4′-sulpho-phenyl)-amide, 4-mercapto-butyric acid N-(β-hydroxyethyl)-amide, 4-mercapto-butyric acid N-(6′-sulpho-naphthyl)-amide, 1-mercapto-butane-4-sulphonic acid, 1-mercapto-n-pentane-5-sulphonic acid, 1-mercapto-hexane-6-sulphonic acid, 10-mercapto-decane-1-sulphonic acid, 4-mercapto-1-diethylaminobutane hydrobromide, 4-mercapto-butane-phosphonic acid, 4-mercapto-butanol-(1), 4-mercapto-butyric acid N-(4′-sulphamoyl-phenyl)-amide, 6-mercapto-caproic acid, 5-mercapto-caproic acid, 3-mercapto-valeric acid, 4-mercapto-valeric acid, 5-mercapto-valeric acid, 3-mercapto-2-(mercaptomethyl)-propionic acid, 2-(mercaptomethyl)-succinic acid, 4-mercapto-butyronitrile, 1,3-dimercapto-2-methylpropane, 5-mercaptopentanephosphonic acid, 3-mercaptopropanephosphonic acid monoethyl ester, 3-mercapto-hexane-1,6-dicarboxylic acid, 4-mercaptobutyric acid β-methoxyethyl ester, 4-mercaptobutyric acid β-hydroxyethyl ester, α-methylmercaptotoluene-4-sulphonic acid, 3- or 4-amino-thio-phenol, 3-mercaptophenyl-N,N,N-trimethylammonium iodide, 4-mercapto-pyridine, 4-mercaptobenzenesulphonic acid, 4-N,N-dimethylamino-1-mercaptobenzene, 5-methyl-4-mercapto-caproic acid, 4,5-dimethyl-4-mercapto-caproic acid and 4,5-dimethyl-5-mercapto-caproic acid.

The sulphur compounds to be used according to the invention can also be added to the dye bleach preparation in the form of their salts, especially of the alkali metal salts, or of inorganic or organic ammonium salts.

In general it suffices to use 1 to 10 mol per cent of the sulphur compound, relative to the amount of iodide present, and if appropriate solvents, such as dimethylformamide, tetrahydrofurane or benzyl alcohol can also be added to the dye bleach preparation.

Examples of suitable acids for the dye bleach baths are sodium bisulphate, sulphamic acid, acetic acid, citric acid, organic sulphonic acid, hydrochloric acid, sulphuric acid or phosphoric acid.

The water-soluble iodide can be, for example, potassium iodide, sodium iodide, ammonium iodide or hydriodic acid.

The dye bleach catalyst can either be dissolved in the dye bleach preparation or be contained in the photographic material to be bleached and can be, for example, a pyrazine, a quinoxaline or a phenazine.

The sulphur compounds can be solid or liquid at room temperature and, as mentioned, their vapour pressure within the temperature range of −20°C to +100°C may only be at most equal to the vapour pressure of water.

Alternatively to being in the form of a bath, the dye bleach preparation can, for example, also be a gel-like thickened composition, in the form of a colloidal mass or photographic layer. By using suitable technical measures such as, for example, providing protective layers or encapsulating the active components, the dye bleach preparations can be introduced into a photographic material in such a way that the dye-bleaching action can only come into operation on processing the photographic material. In special cases, mixtures of the iodide and of the sulphur compounds can also be present as such, whilst the acid and dye bleach catalyst are accommodated in another phase (compare, for example, French Pat. Specification 1,504.238).

When using the dye bleach preparation according to the invention for bleaching reducible image substances, such as azo dyestuffs, nitro dyestuffs and diazonium salts, in the presence of metallic images, these metallic images can, in a known manner, be the converse of the original (negative) or in the same sense as the original (positive). It is desirable, after developing and before the dye-bleaching, to dissolve out of the material all metal salts, such as silver chloride or silver bromide, which may still be present (that is to say to fix the material), since otherwise the iodide content of the dye bleach bath would rapidly be exhausted and major amounts of sparingly soluble silver iodide would form at the same time. After the dye-bleaching, the silver which remains is removed in a known manner.

In addition to the constitutents mentioned, the dye bleach baths can contain customary additives such as complex-forming agents, wetting agents and solvents.

The dye bleach baths according to the present invention remain stable for a long period, do not undergo any discolouration, give results of good reproductibility even in continuously operating machines and in addition exhibit very advantageous behaviour with regard to corrosion of the containers and parts of the apparatus with which they come into contact. The sulphur compounds of the indicated composition which are present in the baths do not increase the corrosiveness and in some cases even reduces it. The particularly favourable behaviour of these sulphur compounds with regard to corrosion, even in comparison with such mercapto compounds as, for example, 1-mercapto-2,3-propanediol or 2-mercaptosuccinic acid, which do not have the composition circumscribed at the beginning of this text, can be demonstrated by various methods, for example also by electrochemical and therefore time-saving methods.

In the examples which follow, percentages denote percentages by weight.

EXAMPLE 1

A silver bromide emulsion dyed with the magenta dyestuff of the formula

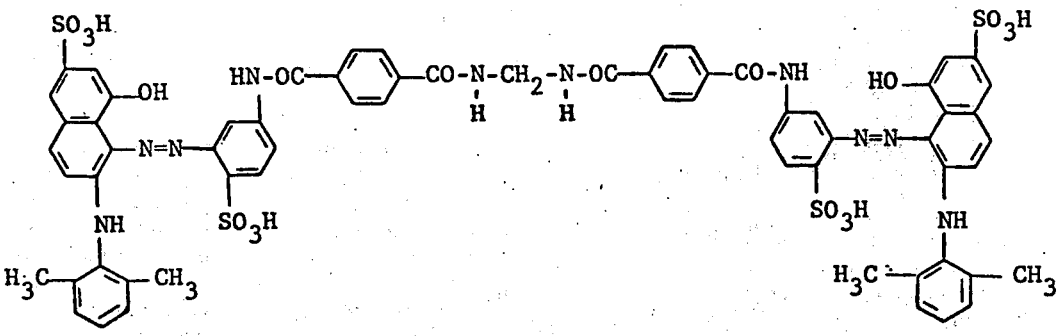

is cast on a film substrate in the usual manner, exposed behind a step wedge and processed at 24°C, as follows:

1. 6 minutes developing,
   2 g of p-methylaminophenol sulphate
   50 of g of anhydrous sodium sulphite
   6 g of hydroquinone
   20 g of anhydrous sodium carbonate
   2 g of potassium bromide
   water to make up to 1 liter.
2. 1 minute stop bath,
   10 g of crystalline sodium acetate
   20 g of glacial acetic acid
   water to make up to 1 liter.
3. 4 minutes fixing, 20% strength solution of sodium thiosulphate.
4. 10 minutes soaking 5. 8 minutes dye bleaching
950 ml of water
27 ml of sulphuric acid (96% strength)
0.5 g of 3-mercaptopropionic acid
20 ml of a mixture of benzyl alcohol (40%), diethylene
glycol (40%) and the water (20%)
10 mg of 6,7-dimethoxy-2,3-dimethyl-quinoxaline
10 g of potassium iodide
water to make up to 1 liter.
6. 4 minutes soaking.

7. 6 minutes silver bleaching
500 ml of water

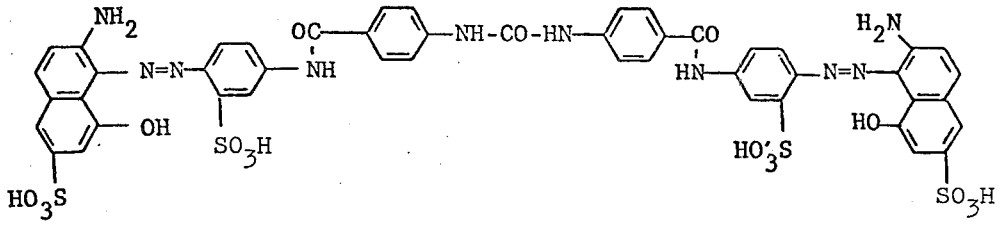

27 ml of sulphuric acid (96% strength)
20 g of crystalline copper sulphate

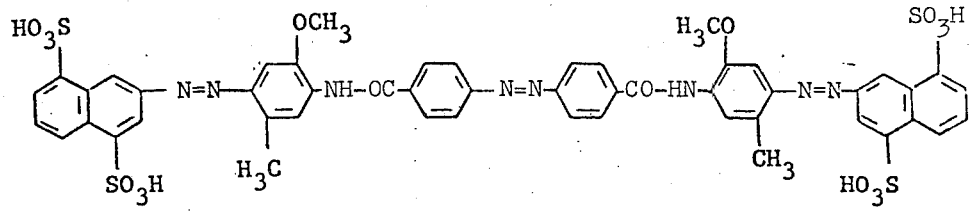

60 g of potassium bromide
water to make up to 1 liter
8. 4 minutes soaking.
9. 4 minutes fixing, 20% strength solution of sodium thiosulphate.
10. 10 minutes soaking.
11. Drying.

A colour image in the same sense as the original, i.e. a positive colour image, is thus obtained.

If the dye bleach bath 5 of the above composition is left to stand for two weeks in an open vessel and the process indicated above is repeated, images which in respect of sensitivity, gradation and fogging are equal to those processed in the freshly mixed dye bleach bath 5 are obtained.

Similar results are obtained if, in the dye bleach 5, of the 0.5 g of 3-mercaptopropionic acid are replaced by 0.5 g of 4-mercaptobutyric acid, 1.0 g of 3-mercaptopropanesulphonic acid, 0.5 g of 3-mercaptobutyric acid or 0.5 g of 4-mercaptovaleric acid, 0.5 g of 3-mercaptopropionic acid amide, 0.5 g of 3-mercaptopropanol-(1), 0.5 g of 4-mecaptobutanol-(1), 0.5 g of 3-mercapto-1-dimethyl-aminopropane, 0.5 g of 3-mercapto-1-di-n-butylaminopropane or 0.5 g of sodium 4-mercaptobutane-1-sulphonate.

EXAMPLE 2

A photographic multi-layer material contains, on a substrate, a gelatine layer containing the dye bleach catalyst 2,3-diphenyl-6-aminoquinoxaline, on top of this a red-sensitive silver halide emulsion layer containing the cyan dyestuff of the formula

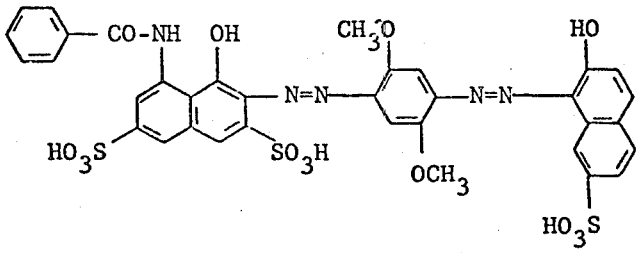

and on top of this green-sensitive silver halide emulsion layer containing the magenta dyestuff of the formula:

This is followed by a silver halide emulsion layer containing the yellow dyestuff of the formula The coloured layers are separated by gelatine layers. This copying material is exposed behind a step wedge and processed in accordance with Example 1. For the dye-bleaching, however, the following bath is used:

27 ml of sulphuric acid (96% strength)
0.8 g of 4-mercaptobutyric acid
25 g of potassium iodide
1 g of anhydrous sodium hydrogen phosphate
water to make up to 1 liter.

A positive image of the step wedge is thus obtained, in which all three dyestuffs have been bleached completely behind the lightest wedge step. The same result is obtained if this dye bleach bath is used after standing for 30 days.

We claim:

1. Dye bleach preparation for the photographic silver dye bleach process which comprises an acid, a water-soluble iodide and at least one organic, at least bifunctional sulphur compound of which the solubility is at least $5\times10^{-4}$ mol per liter of preparation and of which the vapour pressure in the temperature range of −20°C to +100°C is at most as great as that of water, and which contains at least one HS- group and at least one oxygen, nitrogen, phosphorus or additional sulphur atom, with the sulphur atom of each HS—group being separated from the next oxygen, sulphur, nitrogen and phosphorus atom present in the molecule by at least three carbon atoms, wherein the sulphur compound corresponds to the formula $$H - S - A(-B)_m$$

wherein

A denotes an aliphatic, araliphatic, aromatic or heterocyclic bridge member, m denotes an integer of value at most 4 and B denotes are of the groups of the formulae

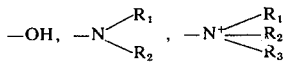

$X^-$, —COOM,

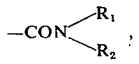

$—SO_3M$,

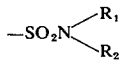

and

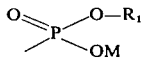

wherein

M denotes a cation,

X denotes an anion, $R_1$ and $R_2$ denote a hydrogen atom, a lower alkyl group, a lower hydroxyalkyl group or the radical of a benzenesulphonic acid and $R_3$ denotes a lower alkyl group and $R_1$ and $R_2$ present on the same nitrogen atom can also form a heterocyclic ring with the latter.

2. Dye bleach preparation according to claim 1 which comprises a sulphur compound as defined in claim 1 and corresponding to the formula $$H - S - A_1(-B_1)_n$$

wherein

*n* is 1 or 2, $A_1$ is an aliphatic bridge member, an aralkylene radical, an aralkylidene radical or a benzene radical which is bonded on non-adjacent carbon atoms to the H—S— and $B_1$ — groups and $B_1$ denotes one of the groups of the formulae

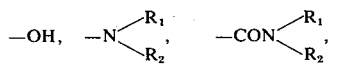

$—SO_3M$ and —COOH wherein $R_1$, $R_2$ and M have the indicated meaning.

3. Dye bleach preparation according to claim 1 which comprises a sulphur compound as defined in claim 1 and corresponding to the formula $$H - S - C_qH_{2q} - B_1$$

having an unbranched carbon chain, wherein $B_1$ denotes one of the groups of the formulae

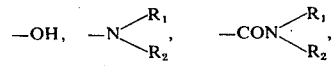

$—SO_3M$ and —COOH wherein $R_1$, $R_2$ and M have the indicated meaning, and

*q* is an integer from 2 to 12.

4. Dye bleach preparation according to claim 1 which comprises a sulphur compound as defined in claim 1 and corresponding to the formula $$H - S - C_qH_{2q} - B_2$$

wherein $B_2$ denotes one of the groups —COOH, $—SO_3$ cation,

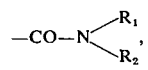

$—N(CH_3)_2$ and $—N(C_2H_5)_2$, wherein $R_1$ and $R_2$ have the indicated meaning and *q* is an integer from 2 to 12.

5. Dye bleach preparation according to claim 1 which comprises a sulphur compound as defined in claim 1 and corresponding to the formula $$H - S - C_rH_{2r} - B_3$$

wherein

*r* is an integer from 2 to 6 and $B_3$ denotes one of the groups —COOH, $—SO_3$ cation and

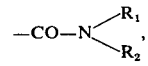

wherein $R_1$ and $R_2$ have the indicated meaning.

6. Dye bleach preparation according to claim 1 which comprises a sulphur compound of the formula

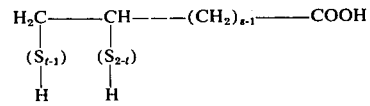

wherein *s* is 1, 2, 3 or 4 and *t* is 1 to 2, but the sum *s*+*t* is at least 3.

7. Dye bleach preparation according to claim 1 which comprises a sulphur compound of the formula $$H - S - C_rH_{2r} - COOH$$

wherein $r$ in an integer of value from 2 to 6.

8. Dye bleach preparation according to claim 1 which comprises the sulphur compound of the formula

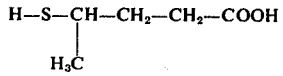

9. Dye bleach preparation according to claim 1 which comprises a sulphur compound of the formula $$H - S - CH_2 - C_sH_{2s} - COOH$$

wherein $s$ is 1, 2, 3 or 4.

10. Dye bleach preparation according to claim 1 which comprises the sulphur compound of the formula $$H - S - CH_2 - CH_2 - COOH.$$

11. Dye bleach preparation according to claim 1 which comprises the sulphur compound of the formula $H - S - CH_2 - CH_2 - CH_2 - COOH$.

12. Dye bleach preparation according to claim 1 which comprises a sulphur compound as defined in claim 1 and corresponding to the formula $$H - S - C_rH_{2r} - B_4$$

wherein r is an integer from 2 to 6 and $B_4$ denotes a carboxylic acid amide group or sulphonic acid group.

13. Dye bleach preparation according to claim 1 which comprises a sulphur compound as defined in claim 1 and corresponding to the formula $$H - S - C_rH_{2r} - SO_3M_1$$

wherein r is an integer of value from 3 to 6 and $M_1$ denotes one of the cations H, Na, K, $NH_4$,

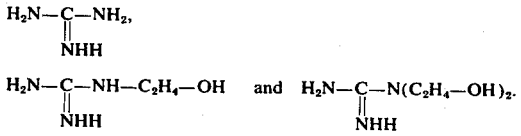

14. Dye bleach preparation according to claim 13 which comprises a sulphur compound of the formula $$H - S - CH_2 - CH_2 - CH_2 - SO_3M_1$$

wherein $M_1$ has the indicated meaning.

15. Dye bleach preparation according to claim 13 which comprises a sulphur compound of the formula $$HS - CH_2 - CH_2 - CH_2 - SO_3M_1$$

wherein $M_1$ has the indicated meaning.

16. Dye bleach preparation according to claim 1 which, in addition to an acid, an iodide and at least one sulphur compound as defined in claim 1, contains a dye bleach catalyst.

* * * * *

UNITED STATES PATENT OFFICE

CERTIFICATE OF CORRECTION

PATENT NO. : 3,961,957

DATED : June 8, 1976

INVENTOR(S) : Ekkehard Kramp et al.

It is certified that error appears in the above-identified patent and that said Letters Patent are hereby corrected as shown below:

Column 7, line 14, delete "are" and insert -- one --.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*